US009711924B2

(12) United States Patent
Wei et al.

(10) Patent No.: US 9,711,924 B2
(45) Date of Patent: Jul. 18, 2017

(54) BRUSH ASSEMBLY FOR AN ELECTRIC MOTOR

(71) Applicant: Johnson Electric S.A., Murten (CH)

(72) Inventors: Hong Min Wei, Shenzhen (CN); Yin Deng, Shenzhen (CN); Bin Liu, Shenzhen (CN); Hui Juan Xing, Shenzhen (CN)

(73) Assignee: Johnson Electric S.A., Murten (CH)

( * ) Notice: Subject to any disclaimer, the term of this patent is extended or adjusted under 35 U.S.C. 154(b) by 266 days.

(21) Appl. No.: 14/689,775

(22) Filed: Apr. 17, 2015

(65) Prior Publication Data

US 2015/0303635 A1 Oct. 22, 2015

(30) Foreign Application Priority Data

Apr. 18, 2014 (CN) ..... 2014 1 0159001

(51) Int. Cl.
*H01R 39/40* (2006.01)
*H01R 39/38* (2006.01)

(52) U.S. Cl.
CPC ..... *H01R 39/381* (2013.01)

(58) Field of Classification Search
CPC ..... H01R 39/381; H01R 39/18; H02K 13/00
USPC ..... 310/247, 248, 239, 242, 245
See application file for complete search history.

(56) References Cited

U.S. PATENT DOCUMENTS 4,994,701 A * 2/1991 Bulick ..... H01R 39/40 310/239
5,397,952 A * 3/1995 Decker ..... H01R 39/415 310/239
5,463,264 A * 10/1995 Koenitzer ..... H01R 39/415 310/242
5,602,957 A 2/1997 Wille et al.
7,973,447 B2 7/2011 Warner et al.

* cited by examiner

*Primary Examiner* — Hanh Nguyen
(74) *Attorney, Agent, or Firm* — Muncy, Geissler, Olds & Lowe, P.C.

(57) ABSTRACT

A brush assembly has a brush, a brush cage, and a spring. The spring is a constant force spring having two coil portions and a connecting portion. The connecting portion the brush are together received in the brush cage. The brush has a contact end arranged to make sliding contact with a commutator and a second end remote from the contact end against which the spring applies its force, to urge the brush out of the brush cage. A hook is formed at each of two opposite sides of the brush cage, at a first end portion of the brush cage adjacent the contact end of the brush. The coil portions respectively engage the hooks. The hooks extend at different angles to a corresponding outer surface of the brush cage.

7 Claims, 2 Drawing Sheets

BRUSH ASSEMBLY FOR AN ELECTRIC MOTOR

CROSS REFERENCE TO RELATED APPLICATIONS

This non-provisional patent application claims priority under 35 U.S.C. §119(a) from Patent Application No. 201410159001.0 filed in The People's Republic of China on Apr. 18, 2014, the entire contents of which are hereby incorporated by reference.

FIELD OF THE INVENTION

This invention relates to a cage brush assembly for an electric motor and, in particular to a brush assembly for use with a constant force spring.

BACKGROUND OF THE INVENTION

Motors are an electromagnetic device for electric energy conversion according to the law of electromagnetic induction, which mainly include direct current motors and alternating current motors. The direct current motors or universal brush motors require a brush assembly. The brush assembly includes a brush and a brush cage. The brush is mounted in the brush cage and is biased by a spring. The brush contacts a commutator to transfer the electrical current from the brush to the commutator.

FIG. 1 illustrates a conventional brush assembly. The brush assembly includes a brush 2, a brush cage 1, and a spring (not shown). The brush 2 is received in the brush cage 1 and biased by the spring. Two stop plates 12 extend outwardly from one end of the brush cage 1. Each stop plate 12 includes a hook 13 at a distal end thereof. The stop plates 12 are configured to stop two coil portions 3 of the spring. When the brush 2 moves toward a commutator under the influence of the force of the spring, i.e. the brush 2 extends out of an end 11 of the brush cage 1, the hooks 13 catch the two coil portions 3 of the spring, making the spring coil up. The two stop plates 12 are at the same angle to an outer surface of the brush cage 1.

However, in the conventional brush assembly, in order to ensure that the brush 2 smoothly extents and retracts in the brush cage 1, the brush 2 and the brush cage 1 usually have a large gap there between, i.e. a side surface 21 of the brush 2 and an inner surface of the brush cage 1 have a large gap there between. As a result, during operation of the motor, vibration of the brush 2 can easily occur which may cause abnormal noises.

SUMMARY OF THE INVENTION

Hence there is a desire for a brush assembly for an electric motor, with improved operational stability which can reduced abnormal noises.

Accordingly, in one aspect thereof, the present invention provides a brush assembly comprising a brush, a brush cage, and a spring, wherein the spring comprises two coil portions and a connecting portion interconnecting the coil portions, the connecting portion of the spring and the brush being together received in the brush cage, the brush having a contact end and a second end remote from the contact end, the connecting portion of the spring abutting against the second end of the brush, a hook is foamed at each of two opposite sides of the brush cage, at a first end portion of the brush cage adjacent the contact end of the brush, each of the two coil portions are connected with a corresponding one of the hooks, and each of the hooks extend at a different angle to a corresponding outer surface of the brush cage.

Preferably, the hooks comprise a first hook and a second hook, each hook comprises a stop plate extending outwardly from the brush cage and a hook portion disposed at a distal end of the stop plate, an angle A is formed between the stop plate of the first hook and the outer surface of the brush cage, an angle B is formed between the stop plate of the second hook and the outer surface of the brush cage, the angle A is not equal to the angle B, and the angle A and the angle B are both greater than 90 degrees but less than 180 degrees.

Preferably, the absolute value of a difference between the angle A and the angle B is greater than zero degree but less than 30 degrees.

Preferably, the angle A is 120 degrees, and the angle B is 105 degrees.

Preferably, the brush cage comprises two sidewalls, and each stop plate extends from a corresponding one of the sidewalls at the first end portion of the brush cage.

Preferably, a cutout is formed between each stop plate and the corresponding hook portion.

Preferably, the spring is a constant-force spring.

According to a second aspect, the present invention provides a motor comprising a stator and a rotor. The rotor comprises a commutator and a winding electrically connected with the commutator. The motor further comprises one or more brush assemblies as described herein before, with the contact end of the or each brush making sliding contact with the commutator to supply power to the winding.

In view of the forgoing, by configuring the stop plates of the hooks with different angles with respect to the corresponding outer surfaces of the brush cage, the brush can be made to abut against one inner surface of the brush cage, thereby reducing the vibration of the brush as well as the abnormal noises caused by the vibration. The motor utilizing this brush assembly has an improved stability and is capable of eliminating abnormal noises during slow-down of the motor after power off

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENT

Figure 1:
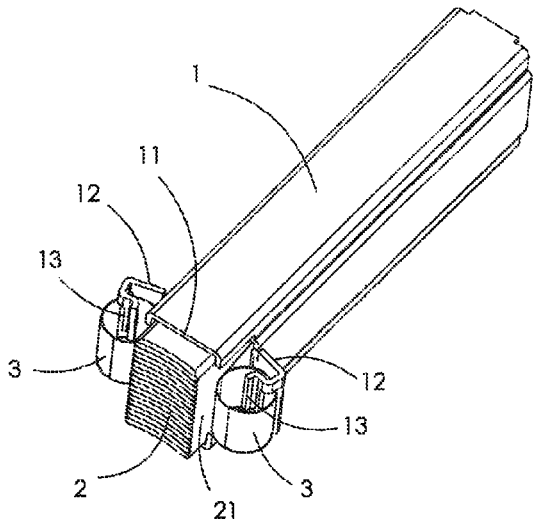
FIG. 1 (Prior Art)
FIG. 1 is a perspective view of a known brush assembly.
Figure 2:
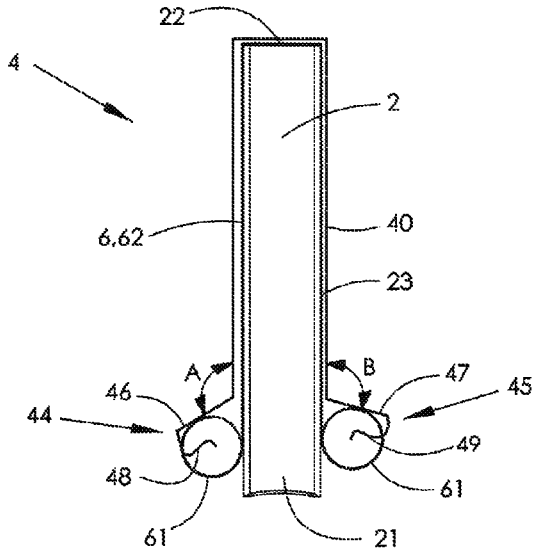
FIG. 2 is a diagrammatic representation of a brush assembly according to the preferred embodiment of the present invention.
Figure 3:
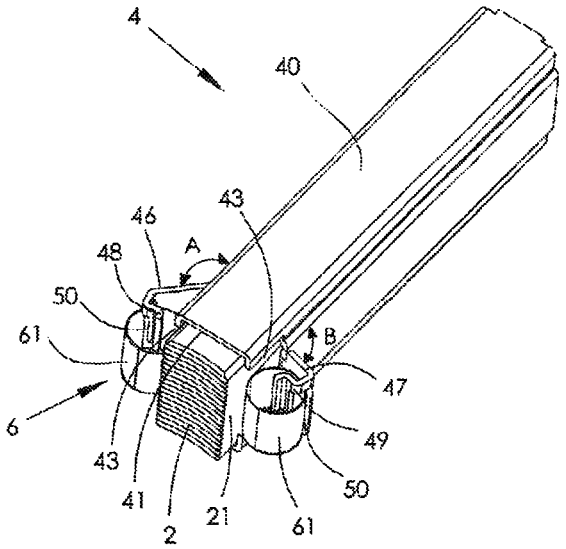
FIG. 3 is a perspective view of a brush assembly of FIG. 2.
Figure 4:
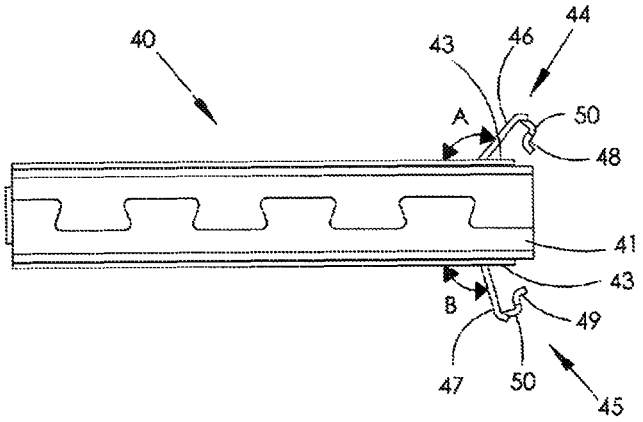
FIG. 4 is a plan view from below of the brush cage of FIG. 3.

FIGS. 2 and 3 illustrate a brush assembly 4 for an electric motor, in according with the preferred embodiment of the present invention. FIG. 2 is a diagrammatic representation used to illustrate the concept while FIG. 3 is a perspective view of the complete brush assembly. The brush assembly 4 includes a brush 2, a brush cage 40, and a spring 6. In the present embodiment, the brush cage 40 is hollow and elongated in shape. The brush 2 includes a contact end 21 and a second end 22 remote from the contact end 21. FIG. 4 illustrates the underside of the brush cage of FIG. 3.

The spring 6 is a constant-force spring, including two coil portions 61 and a U-shaped connecting portion 62 interconnecting the coil portions 61. The connecting portion 62 of the spring 6 abuts against the second end 22 of the brush 2, and the connecting portion 62 of the spring and the brush 2 are together received in the brush cage 40, as shown in FIG. 2.

The brush cage 40 is formed with a hook at each of two sides of a first end portion 41 of the brush cage 40 adjacent the contact end 21 of the brush 2. Each of the coil portions 61 of the spring are connected with a corresponding one of the hooks. Preferably, the hooks include a first hook 44 and a second hook 45. The first hook 44 includes a stop plate 46 extending outwardly from one sidewall of the brush cage 40, and a hook portion 48 formed at a distal end of the stop plate 46. The second hook 45 includes a stop plate 47 extending outwardly from another sidewall of the brush cage 40, and a hook portion 49 formed at a distal end of the stop plate 49. Specifically, each of the sidewalls of the brush cage 40 at one end thereof forms an opening 43, 43. The stop plate 46 extends outwardly from an edge of the opening 43, and the stop plate 47 extends outwardly from an edge of the opening 43.

In the present embodiment, the stop plates 46, 47 are formed by material removed from the openings 43, 43 and, therefore, have a simple structure and can be easily fabricated. A cutout 50 is formed between each stop pate 46, 47 and the corresponding hook 48, 49, to accommodate the coil portion 61 when the hook portion is inserted into the corresponding coil portion 61. Preferably, the brush cage 40 is of a tubular structure made from copper, brass or similar material.

An angle A is formed between the stop plate 46 and an outer surface of the brush cage 40. An angle B is formed between the stop plate 47 and another outer surface of the brush cage 40. Angle A and angle B are not equal and are both greater than 90 degrees but less than 180 degrees. Preferably, the absolute value of a difference between angle A and angle B is greater than zero degrees but less than 30 degrees. In this embodiment, angle A is 120 degrees, and angle B is 105 degrees.

As shown in FIG. 2, during use of the brush assembly 4, uncoiled portions of the two coil portions 61 of the spring tend to be coiled up, such that the connecting portion of the spring exerts a spring force on the second end of the brush to urge the contact end of the brush out of the brush cage into sliding contact with a commutator of the motor in which the brush assembly is mounted. Because angle A is not equal to angle B, when the brush 2 moves along an inner surface of the brush cage 40 to approach the commutator (not shown), the spring coil portion 61 associated with the larger angle A exerts a greater pushing force on a side surface of the brush 2, while the spring coil portion 61 associated with the smaller angle B exerts a smaller pushing force on the other side surface of the brush 2. Under the influence of the two unequal pushing forces, the larger pushing force makes one side surface 23 of the brush abut against the inner surface of the brush cage 40. As such, vibration of the brush 2 as well as the abnormal noises caused by the vibration of the brush 2 can be effectively reduced.

The present invention further provides a motor including a stator and a rotor. The rotor includes a commutator and a winding electrically connected with the commutator. The motor further includes at least one brush assembly 4 as described above. The contact end 21 of the brush 2 of the brush assembly makes sliding contact with the commutator to supply power to the motor winding. It should be understood that the motor can be any type of motor that needs the brush assembly, such as a universal motor or a permanent magnet direct current motor.

In the embodiment described above, the brush 2 is preferably a brush made from carbon or a material containing carbon.

In the description and claims of the present application, each of the verbs "comprise", "include", "contain" and "have", and variations thereof, are used in an inclusive sense, to specify the presence of the stated item or feature but do not preclude the presence of additional items or features.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of example only, and various other modifications will be apparent to persons skilled in the field without departing from the scope of the invention as defined by the appended claims.

The invention claimed is:

1. A brush assembly comprising a brush, a brush cage, and a spring, wherein the spring comprises two coil portions and a connecting portion interconnecting the coil portions, the connecting portion of the spring and the brush being received in the brush cage, the brush comprises a contact end and a second end remote from the contact end, the connecting portion of the spring abutting against the second end of the brush, a hook is formed at each of two opposite sides of the brush cage, at a first end portion of the brush cage adjacent the contact end of the brush, each of the two coil portions is connected with a corresponding one of the hooks, and each of the hooks extends at a different angle to a corresponding outer surface of the brush cage, wherein the hooks comprise a first hook and a second hook, each of the hooks comprises a stop plate extending outwardly from the brush cage and a hook portion disposed at a distal end of the stop plate, an angle A is formed between the stop plate of the first hook and the outer surface of the brush cage, an angle B is formed between the stop plate of the second hook and the outer surface of the brush cage, the angle A is not equal to the angle B, and the angle A and the angle B are both greater than 90 degrees but less than 180 degrees.

2. The brush assembly of claim 1, wherein the absolute value of a difference between the angle A and the angle B is greater than zero degree but less than 30 degrees.

3. The brush assembly of claim 1, wherein the angle A is 120 degrees, and the angle B is 105 degrees.

4. The brush assembly of claim 1, wherein the brush cage comprises two sidewalls, and each stop plate extends from a corresponding one of the sidewalls at the first end portion of the brush cage.

5. The brush assembly of claim 1, wherein a cutout is formed between each stop plate and the corresponding hook portion.

6. The brush assembly of claim 1, wherein the spring is a constant-force spring.

7. A motor comprising a stator and a rotor, the rotor comprising a commutator and a winding electrically connected with the commutator, wherein the motor further comprises the brush assembly of claim 1, the contact end of the brush of the brush assembly making sliding contact with the commutator to supply power to the winding.

* * * * *